United States Patent [19]

Chatfield et al.

[11] 4,159,218

[45] Jun. 26, 1979

[54] METHOD FOR PRODUCING A DUAL-PHASE FERRITE-MARTENSITE STEEL STRIP

[75] Inventors: David A. Chatfield, Coraopolis, Pa.; Robert R. Goodhart, Weirton, W. Va.

[73] Assignee: National Steel Corporation, Pittsburgh, Pa.

[21] Appl. No.: 931,684

[22] Filed: Aug. 7, 1978

[51] Int. Cl.[2] ..... C21D 7/14

[52] U.S. Cl. ..... 148/12 F; 148/12.4; 148/36; 148/144

[58] Field of Search ..... 148/12 R, 12 F, 12.4, 148/144, 36

[56] References Cited

U.S. PATENT DOCUMENTS

| | | | |
|---|---|---|---|
| 3,240,634 | 3/1966 | Nachtman | 148/12.4 |
| 3,281,287 | 10/1966 | Edström et al. | 148/12.4 |
| 3,729,344 | 4/1973 | Lukes et al. | 148/12.4 |
| 3,830,669 | 8/1974 | Matsuoka et al. | 148/12 |
| 3,917,492 | 11/1975 | Backman et al. | 148/12.4 |
| 3,951,696 | 4/1976 | Gondo et al. | 148/12 F |
| 4,033,789 | 7/1977 | Hamburg et al. | 148/12 F |
| 4,040,872 | 8/1977 | Mudiare | 148/12.4 |
| 4,062,700 | 12/1977 | Hayami et al. | 148/12 F |
| 4,072,543 | 2/1978 | Coldren et al. | 148/12 F |
| 4,088,511 | 5/1978 | Rowney | 148/12.4 |

*Primary Examiner*—W. Stallard

*Attorney, Agent, or Firm*—Shanley, O'Neil and Baker

[57] ABSTRACT

A dual-phase steel strip is produced by heating a hot rolled steel strip to a temperature within the intercritical temperature range, annealing the heated strip for a period of from 15 seconds to 5 minutes, and controlling the average cooling rate to about 3.6F.°-45F.°/sec. (2C.°-25C.°/sec.) down to the martensite formation temperature of about 850° F.±100° F. (454° C.±56° C.). The hot rolled strip will have a chemical composition of 0.08 to 0.12% C, 1.25 to 1.8% Mn, 0.5 to 0.7% Si, and 0.1 to 0.7% Cr, the balance being substantially Fe.

10 Claims, No Drawings

METHOD FOR PRODUCING A DUAL-PHASE FERRITE-MARTENSITE STEEL STRIP

BACKGROUND OF THE INVENTION

This invention relates to a method for producing high-strength steel strip having exceptional formability and a ferrite-martensite, dual-phase structure.

The demand for easily formable, high-strength steel strip has increased steadily in recent times, most notably in the automotive industry where structural safety considerations have had to be reconciled with production requirements.

In an effort to meet this demand, a variety of steels and methods for their production have been proposed previously, among which are included several dual-phase steels, such as disclosed, for example, in U.S. Pat. Nos. 3,951,696, 4,033,789, and 4,062,700. However, none of the prior disclosures deal with a predominantly ferrite-martensite material structure which is achieved through the unique combination of chemical composition and heat treating techniques proposed in the present invention.

SUMMARY OF THE INVENTION

According to the present invention, a method is provided for producing a high-strength steel strip having excellent formability, and this constitutes a principal object of the invention. It is also an object of this invention to provide a process for producing a steel strip which is characterized by a dual-phase, ferrite-martensite microstructure. It is still further an object of this invention to produce a relatively lower cost dual-phase steel strip having high-strength and ductility. These and other objects of the invention have been attained by means of the method described below.

As previously indicated, this invention is made possible through a unique balance of chemical composition and heat treating techniques. The steel which is utilized in this invention consists essentially, by weight, of from 0.08 to 0.12% carbon, 1.25 to 1.8% manganese, 0.5 to 0.7% silicon and 0.1 to 0.7% chromium, the balance being substantially iron. Of course, sulfide forming elements, such as the rare earths, may also be present in the steel composition to influence inclusion shape control, as well as other elements such as Ni, Cu, Sn, and P, but only in very small or trace amounts. For example, a typical composition may additionally contain about 0.04% Ni, 0.08% Cu, 0.008% Sn, and 0.011% P.

The steel is formed into an as-rolled strip by hot rolling and then subjected to heat treatment in order to transform it into a dual-phase ferrite-martensite structure. This heat treatment, preferably featuring a continuous annealing operation, comprises heating the steel strip to a temperature between the $A_1$ and $A_3$ transformation points, i.e. within the intercritical temperature range of about 1337° F.–1616° F. (725° C.–880° C.), holding it within the selected range temperature for about 15 seconds to 5 minutes, then cooling at a rate of 3.6° F.–45° F./sec. (2° C.–25° C./sec.), preferably 3.6° F.–27° F./sec. (2° C.–15° C./sec.), and most preferably 9° F.–27° F./sec. (5° C.–15° C./sec.) down to the martensite forming temperature, for example 850° F.±100° F. (454° C.±56° C.), after which the cooling rate is relatively unimportant. The resulting dual-phase steel strip will comprise a predominantly ferrite matrix with about 10–25% martensite, preferably 10–15% martensite. The resulting steel strip typically is free of yield point elongation and exhibits an as-annealed yield strength of 40–60 ksi, a tensile strength between 70–100 ksi, and an as-annealed total elongation of 27%–35% in 2 inches.

DESCRIPTION OF THE PREFERRED EMBODIMENTS

As previously indicated, the steel utilized in this invention will consist essentially, by weight, of from 0.08 to 0.12% carbon, 1.25 to 1.8% manganese, 0.5 to 0.7% silicon and 0.1 to 0.7% chromium, the balance being substantially iron. The addition of chromium contributes significantly to the desired properties of the steel since it increases hardenability at a cost factor significantly lower than that found in a steel having an increased manganese content.

It was also previously indicated that rare earth elements may be added to the composition as sulfide inclusion shape control agents, but other elements such as titanium or zirconium may perform this function as well. In any event, the addition of any such sulfide forming, shape control agent will be limited to an amount less than about 0.1% by weight.

Nitrogen may be added to increase post-forming strength of the composition but only if zirconium or titanium are absent from the composition, since those elements preferentially combine with nitrogen before the sulfur, thus limiting the intended effectiveness of the nitrogen and such sulfide forming elements.

Whichever composition is selected within the constraints of the above-mentioned parameters, a steel strip is ultimately formed by hot rolling techniques. Any of the conventional techniques will be suitable for such purposes, although in the preferred embodiment a hot rolling technique will be selected with controlled finishing and coiling temperature, i.e. a finishing temperature of about 1652° F. (900° C.) and a coiling temperature of about 1094° F. (590° C.).

In order to achieve the desired dual-phase structure of this invention, the as-rolled steel strip is subjected to an annealing process, preferably a continuous process, which comprises heating the steel strip to a temperature between the $A_1$ and $A_3$ transformation points, maintaining the sheet within that temperature range for a period of from about 15 seconds to 5 minutes and cooling at a rate of about 3.6° F.–45° F./sec. (2° C.–25° C./sec.), preferably 3.6° F.–27° F./sec. (2° C.–15° C./sec.), and most preferably 9° F.–27° F./sec. (5° C.–15° C./sec.) down to the martensite forming temperature, for example 850° F.±100° F. (454° C.±56° C.). Specifically the annealing process will be maintained within the intercritical temperature range of 1337° F.–1616° F. (725° C.–880° C.), preferably 1400° F.–1499° F. (760° C.–815° C.), and most preferably 1450° F. (788° C.). By heating to such a temperature range, a two-phase structure of ferrite and austenite is formed. However, when subjected to the controlled cooling described above, a substantial amount of the austenite is converted into a hard phase, including a predominant amount of martensite, i.e. about 10–25%, preferably 10–15%, by weight of the total, which is disbursed throughout the ferrite matrix.

The cooling is of considerable importance since deviation from the stated rate will result in the formation of significant amounts of unwanted phases. For example, cooling at a slower rate will produce unwanted amounts of pearlite, bainite, and the like, whereas cooling at a higher rate will result in the formation of too much martensite.

The following examples will further illustrate the invention.

EXAMPLE 1

Steel strip having a thickness of 0.111 inch (2.82 mm) was produced by conventional hot rolling techniques utilizing a finishing temperature of about 1652° F. (900° C.) and a coiling temperature of about 1094° F. (590° C.). The steel strip had a chemical composition including 0.11% C, 1.37% Mn, 0.012% P, 0.50% Si, 0.057% Cu, 0.19% Cr, 0.030% Ni and 0.024% Mo, and a balance consisting essentially of Fe. The strip was heated to about 1500° F. (816° C.) and maintained at that temperature for one minute followed by a controlled cooling at a rate of about 20° F./sec. (11° C./sec.) to about 900° F. (482° C.) and then air cooled to about room temperature. The mechanical properties of the resulting strip are shown below in Table 1.

EXAMPLE 2

Hot-rolled steel strip having a rare-earth treated composition including 0.10% C, 1.27% Mn, 0.50% Si, and 0.47% Cr, was processed essentially according to the method described in Example 1, except various cooling rates were employed to illustrate the inferior properties achieved when the steel is cooled at a rate outside the range of this invention. The results are shown below in Table 2.

The high yield point elongation and relatively lower ultimate tensile strength exhibited in the sample produced with a cooling rate of 2° F./sec., clearly illustrate the importance of maintaining the cooling rate within the range specified herein.

TABLE 1

| Position | Sample Orientation | Yield Strength ksi | Yield Strength MPa | Ultimate Tensile Strength ksi | Ultimate Tensile Strength MPa | Yield Point Elong. (%) | Total Elong. (% in 2" or 50.8 mm) | Uniform Elong. (%) |
|---|---|---|---|---|---|---|---|---|
| Front-Edge 1 | Longitudinal | 53.3 | 367 | 92.6 | 638 | Trace | 29.8 | 21.9 |
| Front-Edge 2 | " | 54.7 | 377 | 94.4 | 651 | Trace | 31.0 | 21.6 |
| Front-Center | " | 52.5 | 362 | 92.4 | 637 | Trace | 30.5 | 21.2 |
| Front-Center | Transverse | 55.2 | 381 | 91.8 | 633 | Trace | 31.5 | 21.8 |

TABLE 2

| Approx. Cooling Rate (F.°/sec) | Yield Strength (ksi) | Ultimate Tensile Strength (ksi) | Yield Point Elong. (%) | Total Elong. (% in 2" or 50.8 mm) | Uniform Elong. (%) |
|---|---|---|---|---|---|
| 2 | 52.3 | 77.3 | 1.8 | 30.7 | 20.0 |
| 4 | 43.0 | 83.3 | 0.0 | 27.5 | 19.4 |
| 6 | 40.0 | 85.0 | 0.0 | 27.7 | 19.4 |
| 6.8 | 49.5 | 99.5 | 0.0 | 24.5 | 16.8 |

The above embodiments are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

We claim:

1. A method for producing a dual-phase steel strip having high strength and formability which comprises providing a hot rolled steel strip containing from 0.08 to 0.12% carbon, 1.25 to 1.8% manganese, 0.5 to 0.7% silicon and 0.1 to 0.7% chromium, the balance being substantially iron, heating said steel strip to a temperature within the intercritical temperature range between the $A_1$ transformation point and the $A_3$ transformation point, annealing said strip in said temperature range for a period of from 15 seconds to 5 minutes, and cooling said annealed strip with an average cooling rate of about 3.6° F.–45° F./sec. (2° C.–25° C./sec.) down to a martensite formation temperature of about 850° F.±100° F. (454° C.±56° C.).

2. A method according to claim 1 wherein said steel contains 0.2 to 0.4% chromium.

3. A method according to claim 1 wherein the annealing is performed within the temperature range of 1337° F.–1616° F. (725° C.–880° C.).

4. A method according to claim 3 wherein the annealing is conducted within a temperature range of 1400° F.–1499° F. (760° C.–815° C.).

5. A method for producing a dual-phase ferrite-martensite steel strip having high strength and formability comprising hot rolling a steel containing from 0.08 to 0.12% carbon, 1.25 to 1.8% manganese, 0.5 to 0.7% silicon and 0.1 to 0.7% chromium, the balance being substantially iron, heating said hot rolled steel to a temperature within the intercritical range of 1337° F.–1616° F. (725° C.–880° C.), annealing the steel in said temperature range for a period from 15 seconds to 5 minutes, and cooling the steel with an average cooling rate of about 3.6° F.–45° F./sec. (2° C.–25° C./sec.), down to a martensite formation temperature of about 850° F.±100° F. (454° C.±56° C.).

6. A method according to claim 5 wherein said steel contains 0.2 to 0.4% chromium.

7. A method according to claim 5 wherein the hot rolling is conducted with a finishing temperature of about 1650° F. (900° C.) and a coiling temperature of about 1094° F. (590° C.).

8. A method according to claim 5 wherein the intercritical temperature range employed is 1400° F.–1499° F. (760° C.–815° C.).

9. A method according to claim 5 wherein the resulting dual-phase steel contains about 10–25% by weight martensite.

10. A dual-phase steel strip having high strength and formability produced according to the method of claim 1.

* * * * *